US010673129B2

(12) United States Patent
Chao et al.

(10) Patent No.: US 10,673,129 B2
(45) Date of Patent: Jun. 2, 2020

(54) STRUCTURAL PROVISIONS FOR AN ADAPTER PLATE FOR CONVERSION OF AN AIRBORNE ANTENNA ATTACHMENT INTERFACE

(71) Applicant: The Boeing Company, Chicago, IL (US)

(72) Inventors: Peter L. Chao, Fullerton, CA (US); Geoffrey Elson, Huntington Beach, CA (US); David W. Bowen, Cherry Hill, NJ (US); Dinesh J. Trivedi, Wilmington, DE (US); Babu R. Meka, Wayne, PA (US)

(73) Assignee: The Boeing Company, Chicago, IL (US)

( * ) Notice: Subject to any disclaimer, the term of this patent is extended or adjusted under 35 U.S.C. 154(b) by 47 days.

(21) Appl. No.: 15/941,582

(22) Filed: Mar. 30, 2018

(65) Prior Publication Data

US 2019/0305408 A1 Oct. 3, 2019

(51) Int. Cl.
*H01Q 1/28* (2006.01)
*H01Q 1/42* (2006.01)

(52) U.S. Cl.
CPC ..... *H01Q 1/281* (2013.01); *H01Q 1/42* (2013.01)

(58) Field of Classification Search
CPC ..... H01Q 1/281; H01Q 1/42; H01Q 1/28; H01Q 1/12; H01Q 1/286
See application file for complete search history.

(56) References Cited

U.S. PATENT DOCUMENTS

| | | | | |
|---|---|---|---|---|
| 9,614,272 | B2 | 4/2017 | Wallace | |
| 9,761,939 | B2 | 9/2017 | Pietila et al. | |
| 2012/0086613 | A1* | 4/2012 | Lundeen | H01Q 1/1214 343/705 |
| 2014/0110526 | A1* | 4/2014 | De Azevedo | B64C 1/36 244/118.1 |
| 2015/0207214 | A1* | 7/2015 | Wallace | H01Q 1/42 343/705 |
| 2017/0054208 | A1* | 2/2017 | Pietila | H01Q 3/24 |
| 2018/0351243 | A1* | 12/2018 | Lewis | H01Q 1/42 |

* cited by examiner

*Primary Examiner* — Hai V Tran
*Assistant Examiner* — Awat M Salih
(74) *Attorney, Agent, or Firm* — Felix L. Fischer

(57) ABSTRACT

An antenna and radome assembly has an adapter plate engaging a first fitting configuration mounted to an aircraft fuselage. The adapter plate mechanically supports an antenna assembly wherein the antenna assembly is originally configured for a second fitting configuration. A radome is attached to the adapter plate enclosing the antenna assembly. The adapter plate has at least a nose portion providing reactive structure adapted to transform a longitudinal load on the radome into an induced downward vertical deflection.

18 Claims, 10 Drawing Sheets

STRUCTURAL PROVISIONS FOR AN ADAPTER PLATE FOR CONVERSION OF AN AIRBORNE ANTENNA ATTACHMENT INTERFACE

BACKGROUND INFORMATION

Field

Implementations shown in the disclosure relate generally to airborne antenna mounting on aircraft and more particularly to implementations for an adapter plate to accommodate mechanical support of an antenna and radome with structural provisions for load path shifting to accommodate an attachment interface conversion.

Background

Airborne antennas for applications such as internet connectivity often are mounted externally to commercial aircraft fuselages. Mounting structure is established at aerodynamically and operationally attractive locations and typically requires fitting or lug attachments transferring aerodynamic loads and, in particular, bird strike loads for the protruding radome, into the aircraft structure. Standard fitting and lug attachments are established which provide a desired load path into the aircraft structure. However, accommodating antenna and radome assemblies or arrangements which are designed for use with one standard fitting and lug combination on aircraft having an alternative fitting and lug combination may be required. It is therefore desirable to provide an interface conversion which provides the necessary attachment interface while properly redirecting operational and bird strike loads.

SUMMARY

Exemplary implementations provide an antenna and radome assembly having an adapter plate engaging a first fitting configuration mounted to an aircraft fuselage. The adapter plate mechanically supports an antenna assembly wherein the antenna assembly is originally configured for a second fitting configuration. A radome is attached to the adapter plate enclosing the antenna assembly. The adapter plate has at least a nose portion providing reactive structure adapted to transform a longitudinal load on the radome into an induced downward vertical deflection.

The exemplary implementations allow a method for attachment and operation of an antenna assembly wherein an adapter plate with reactive structure adapted to be stiffer in a vertical direction and having a configuration for load transfer around forward lugs of a first fitting configuration is connected to the first fitting configuration. An antenna assembly is mounted to the adapter plate. A longitudinal load is transferred through a forward arcuate portion of the adapter plate and the transferred load is reacted as vertical loads in intermediate and aft clevises/lug.

BRIEF DESCRIPTION OF THE DRAWINGS

The features, functions, and advantages that have been discussed can be achieved independently in various implementations of the present disclosure or may be combined in yet other implementations further details of which can be seen with reference to the following description and drawings.

DETAILED DESCRIPTION

The exemplary implementation described herein provides a mechanical interface to resolve the mismatch between structural provisions of a first standard fitting configuration, the ARINC 761 Connexion by Boeing as an example, and outside antenna equipment designed for engagement by a second standard fitting configuration, ARINC 791 for the example herein. The discrepancies between the two fitting configurations and the associated structural requirements occur at the mechanical joints between the antenna and the airplane fuselage. The number of mechanical joints that are provided on the fuselage by the first standard fitting configuration is greater than the intended number of structural supports for the ARINC 791 compatible antenna. The implementation provides the necessary mechanical interfaces to support antenna radome in addition to the necessary structural support for the outside antenna equipment and the radome during bird strike impact, rapid decompression of the fuselage, thermal load and random vibration due to the operation of airplane.

Figure 1:
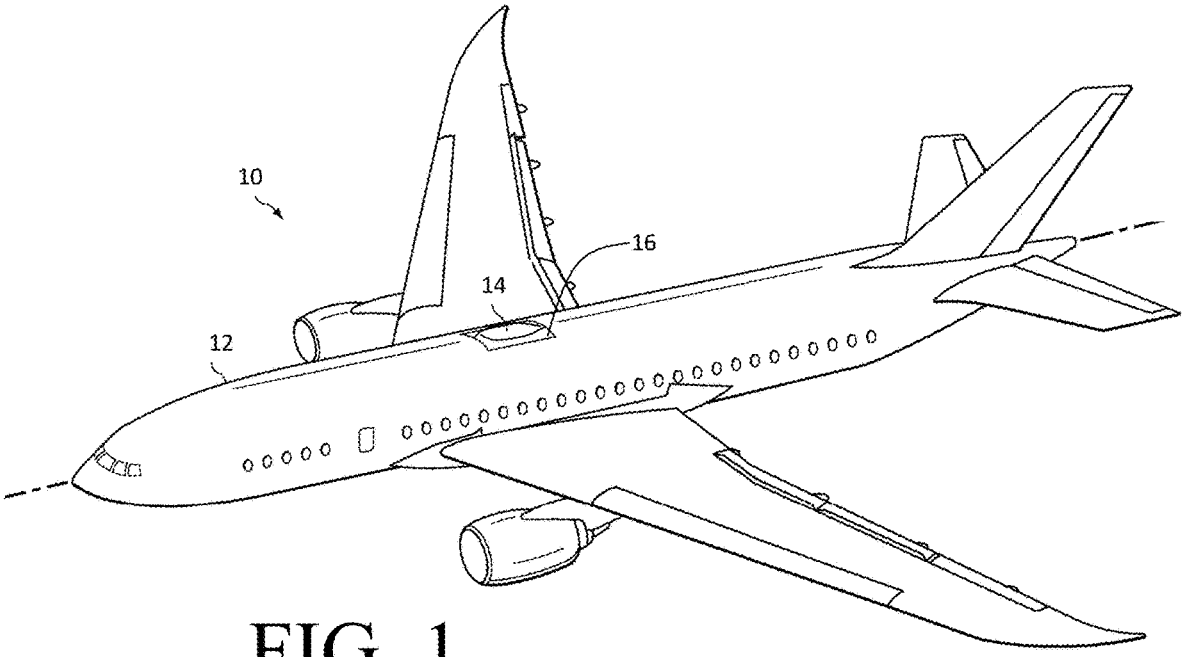
FIG. 1 is a representation of an exemplary aircraft incorporating a radome.
Figure 2A:
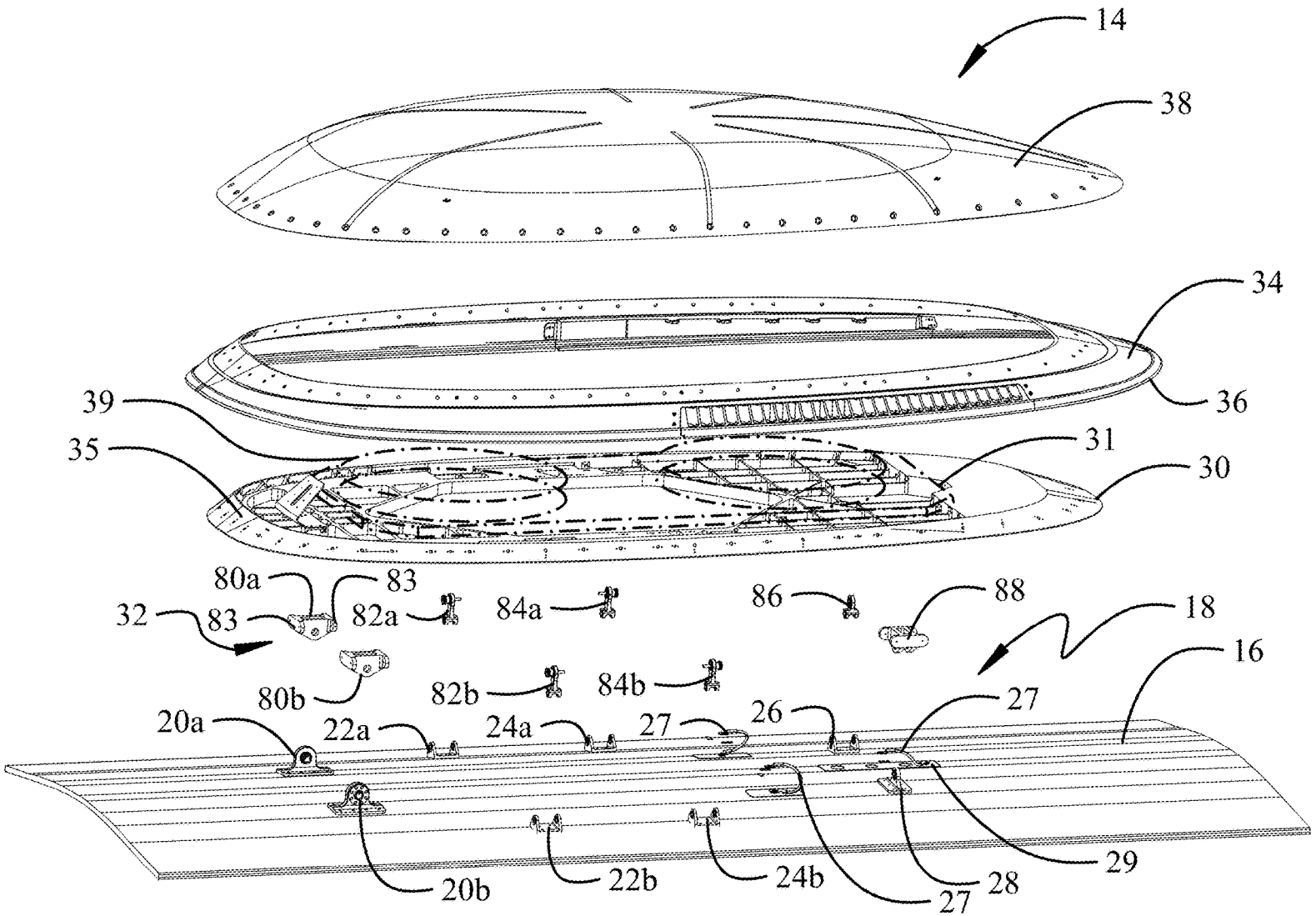
FIG. 2A is an exploded pictorial representation of an exemplary implementation of an adapter plate for a first fitting configuration.
Figure 2B:
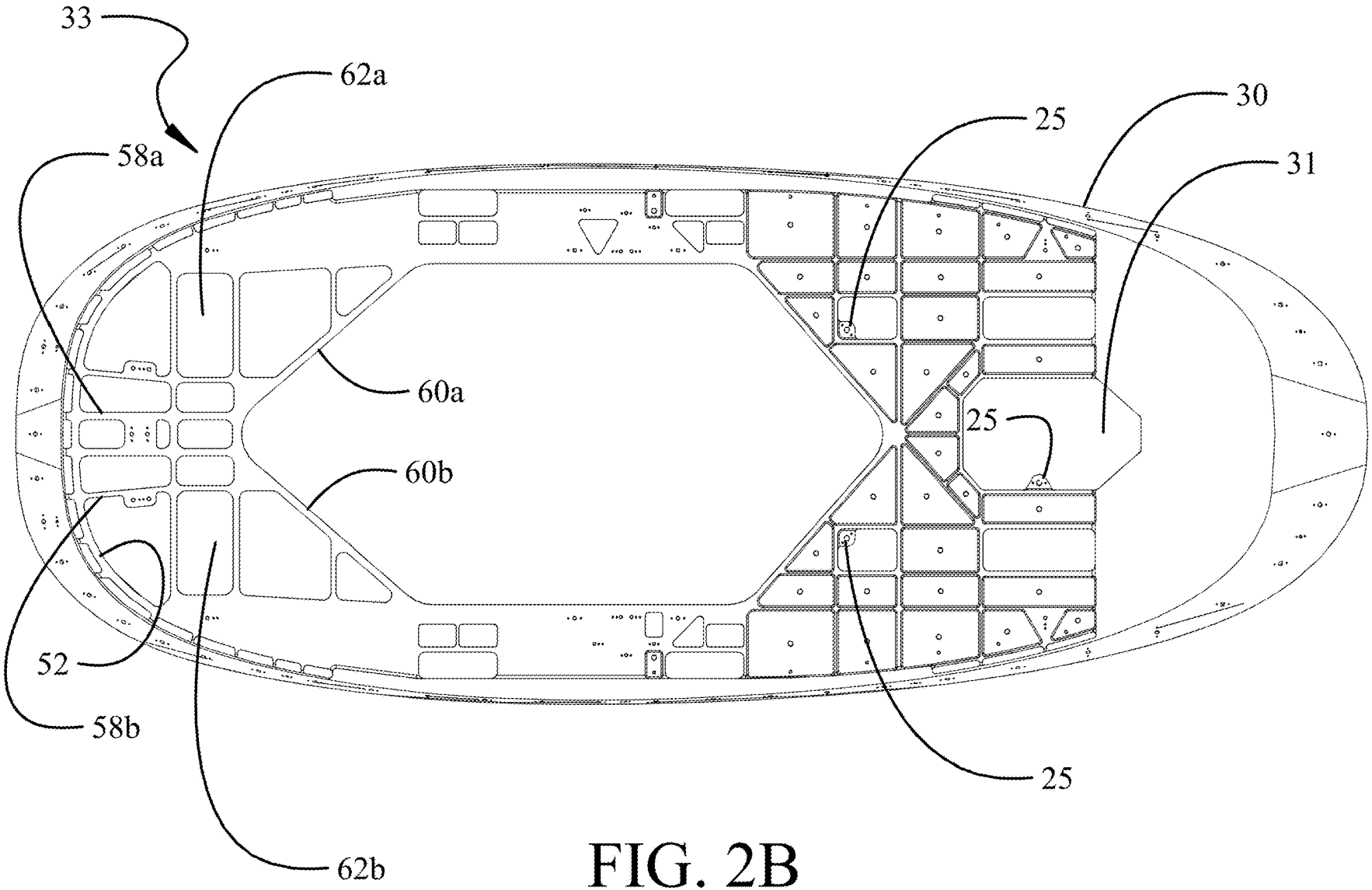
FIG. 2B is a top view of the adapter plate.

Referring to the drawings, FIG. 1 shows an exemplary aircraft 10 with a fuselage 12 on which an antenna and radome assembly 14 is mounted. As seen in FIG. 2A, a top surface 16 of the fuselage 12 incorporates a first fitting configuration 18 (described in greater detail with regard to FIG. 3) which includes two forward lugs 20*a*, 20*b*, a pair of first intermediate clevises 22*a*, 22*b*, a pair of second intermediate devises 24*a*, 24*b*, an aft clevis 26 (aft relative to a direction of flight) and an aft lug 28. An adapter plate 30 (shown in detail in FIG. 2B) is engaged to the first standard fitting configuration 18 with a connector elements set 32, to be described in greater detail subsequently. A skirt fairing 34, which incorporates a seal 36, and a radome 38 are engaged to the adapter plate 30 on a skirt flange 35. An antenna assembly 39 is mounted to the adapter plate 30 for operation and enclosed by the radome 38.

Figure 3:
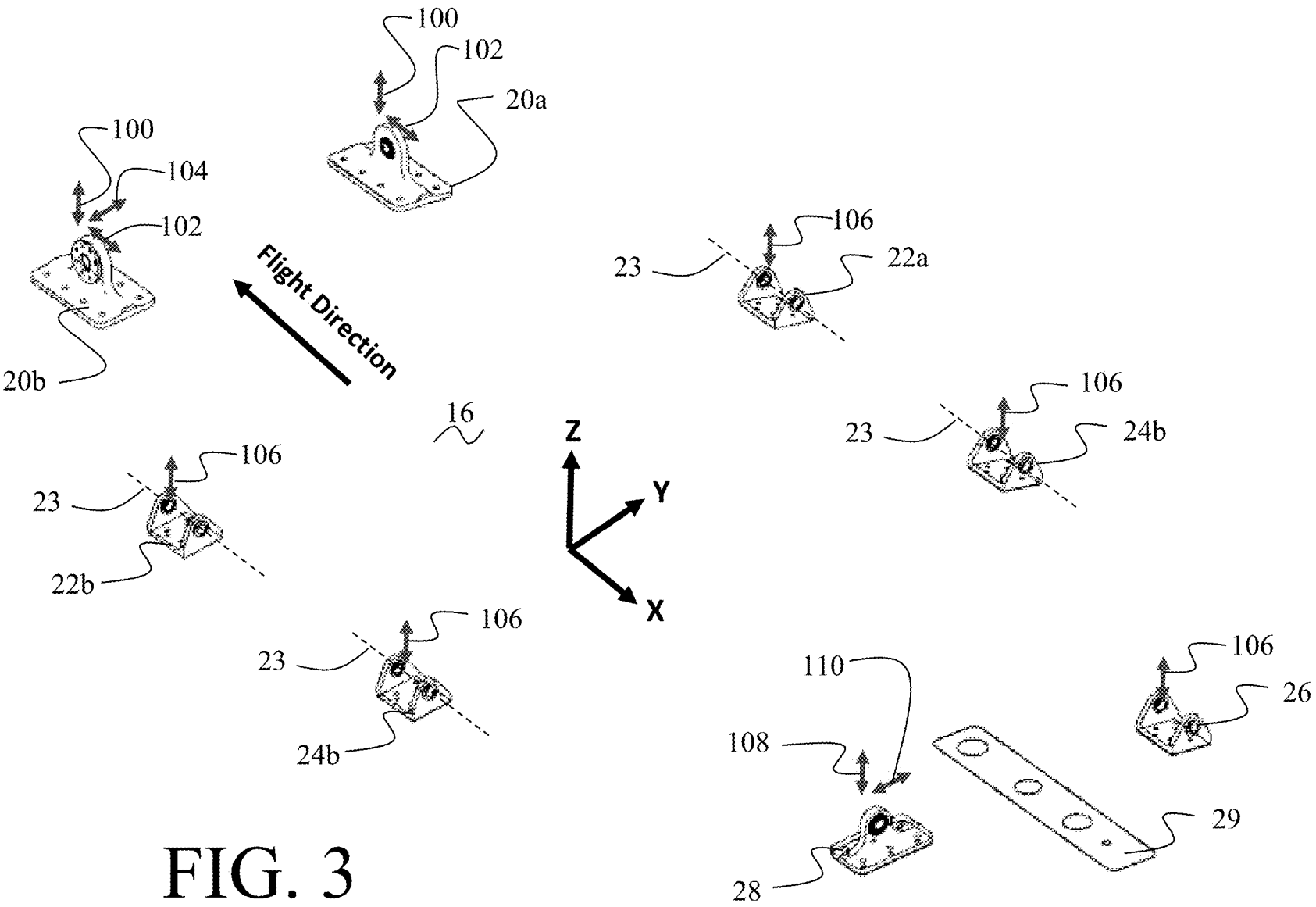
FIG. 3 is a pictorial view of the first fitting configuration.

The first fitting configuration 18 which provides attachment of the adapter plate 30 to the fuselage upper surface 16 and underlying structure is shown in FIG. 3. Forward lugs 20*a*, 20*b* provide reaction of forces vertically (Z axis) as represented by arrows 100, longitudinally (X axis parallel to a direction of flight) as represented by arrows 102, and laterally (Y axis) as represented by arrows 104. First intermediate devises 22*a*, 22*b*, second intermediate devises 24*a*, 24*b*, an aft clevis 26 provide reaction of forces vertically as represented by arrow 106. Aft lug 28 provides reaction of forces vertically as represented by arrow 108 and laterally as represented by arrow 109. Associated with the first fitting configuration 18 is a data/signal bulkhead connection 29 located intermediate the aft clevis 26 and aft lug 28. The adapter plate 30 includes a relief 31 (best seen in FIGS. 2A and 2B) for clearance to connect electrical wiring from the antenna assembly 39 to the data/signal bulkhead connection 29. Grounding connections 27 (seen in FIG. 2A) are provided at three locations; two laterally spaced intermediate the second intermediate devises 24*a*, 24*b* and the aft clevis 26 and aft lug 28 and one mounted to the data/signal bulkhead connection 29. The grounding connections 27 are attached to the adapter plate 30 at pads 25 (seen in FIG. 2B). The adapter plate 30 is constructed of an aluminum alloy and serves as the grounding path for the antenna(s) in the antenna assembly 39 to the fuselage upper surface 16 and aircraft structure.

Figure 4:
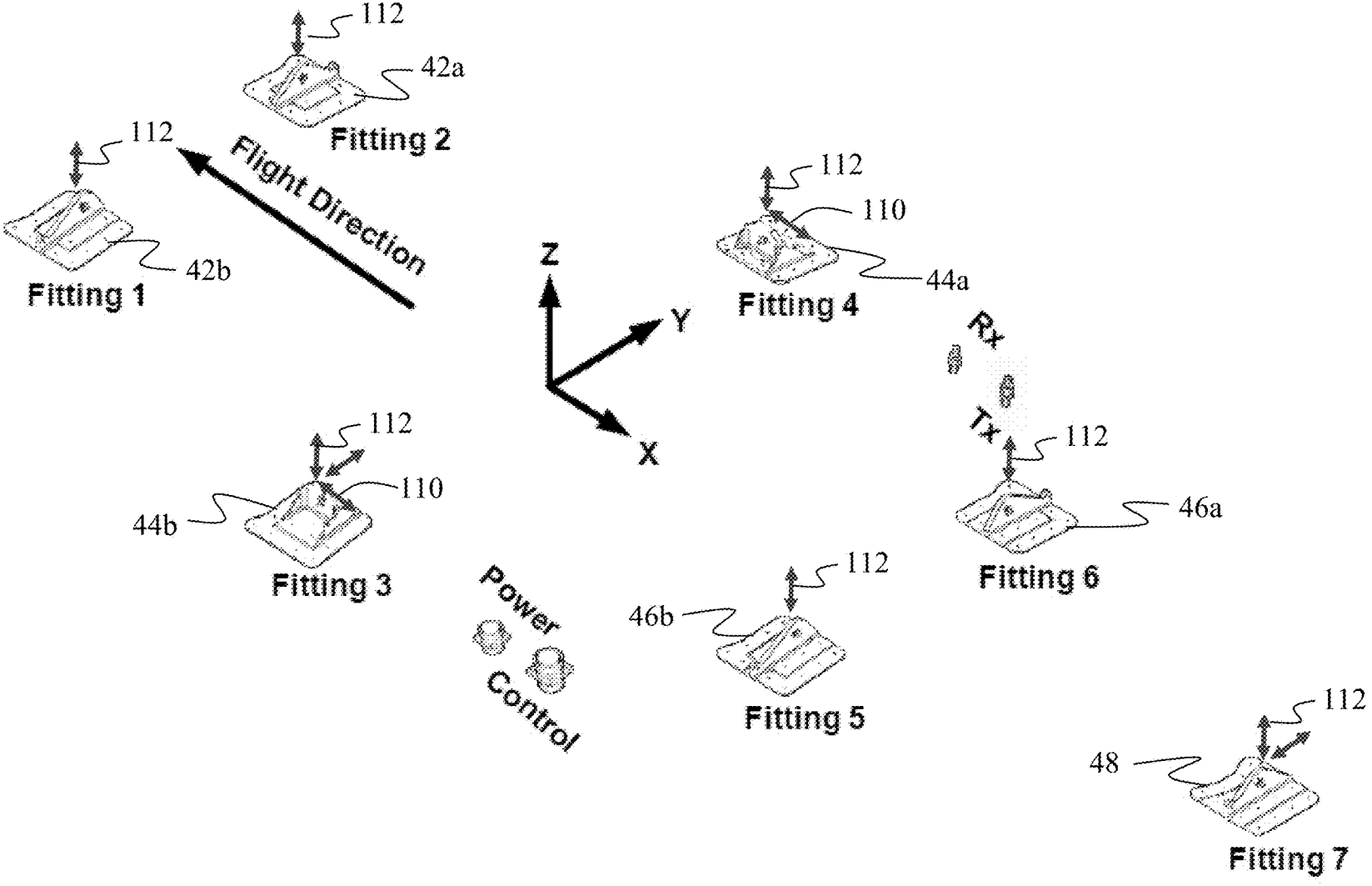
FIG. 4 is a pictorial view of a second fitting configuration.

The second fitting configuration 40, which is employed for various antenna configurations, is shown in FIG. 4. The second fitting configuration 40 has forward fittings 42*a*, 42*b*, main fittings 44*a*, 44*b*, intermediate fittings 46*a* and 46*b* and aft fitting 48. Main fittings 44*a* and 44*b* are attached to the airframe and are the only fittings in the second fitting configuration 40 that can react longitudinal (X axis) forces as represented by arrows 110. Due to the fact that the main fittings 44*a*, 44*b* are aft of the forward fittings 42*a*, 42*b*, any longitudinal forces on an attached radome are partially transformed into vertical deflection (Z-axis) in a conventional attachment plate for antenna configurations employing the second fitting configuration, and that vertical deflection is then reacted by the remaining fittings as represented by arrows 112. Antenna assembly 39 is normally attached to an aircraft employing the second fitting configuration 40.

Antenna configurations designed for attachment to an aircraft with the second fitting configuration 40 are sized and positioned to accommodate the elements of the second fitting configuration (at least 42*a*, 42*b*, 44*a*, 44*b*, 46*a* and 46*b*) outside of the footprint of the antenna assembly 39. The resulting configuration of the antenna assembly 39 therefor typically would overlap the elements of the first fitting configuration 18. Consequently, the adapter plate 30 must accommodate both the connection of the adapter plate to the first fitting configuration 18 and the connection of the antenna assembly 39 to the adapter plate. The connector element set 32 (described in greater detail subsequently) allows interference free engagement by both the connector element set 32 and the adapter plate 30, and the antenna assembly 39 and adapter plate thereby eliminating any requirement to interface with fittings in a configuration of the second fitting configuration 40.

Figure 5:
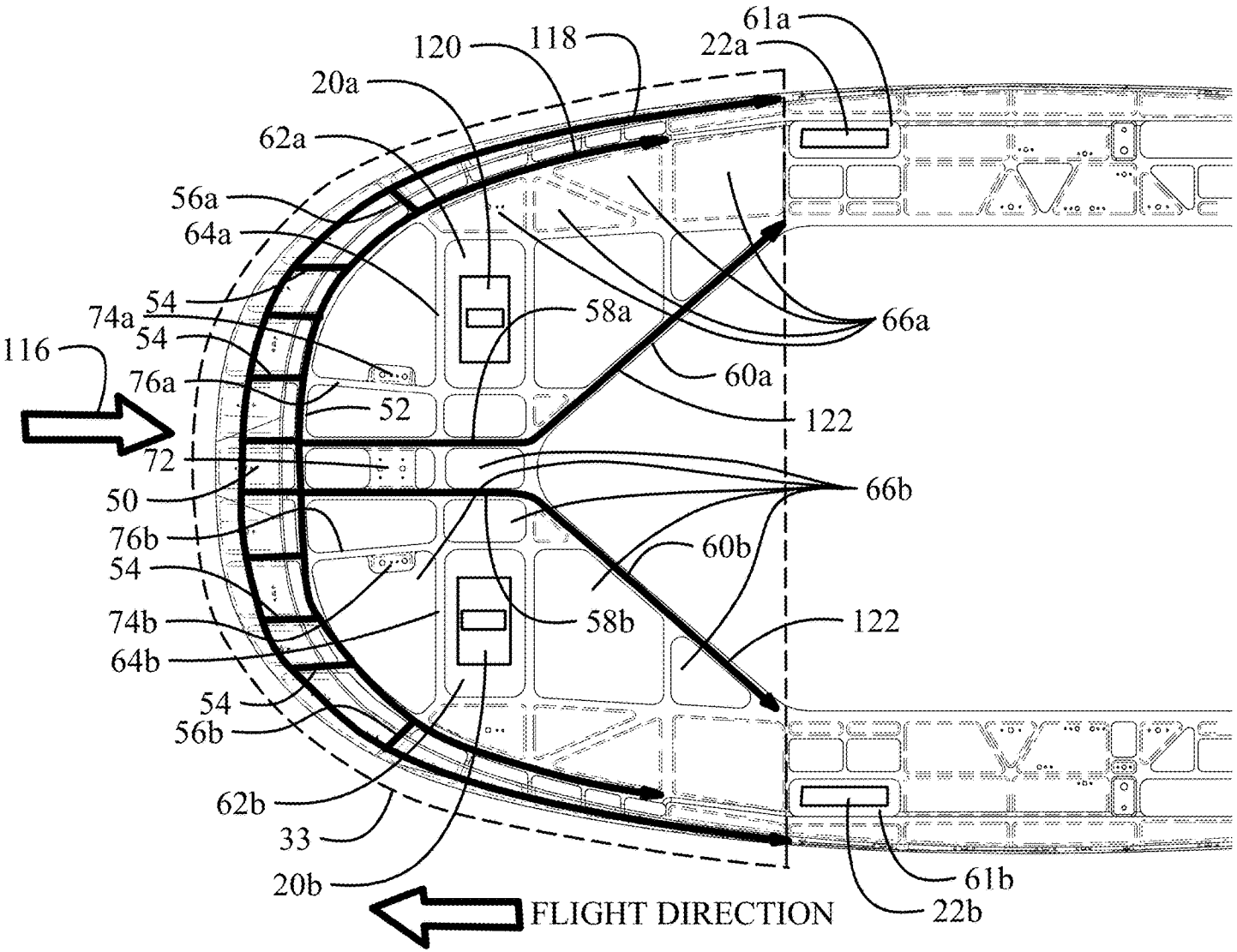
FIG. 5 is a partial top view of a forward portion of the adapter plate showing load paths for redirection of bird strike impact loads.

In the first fitting configuration 18, lugs 20*a* and 20*b* are the only structural attachment that can react longitudinal loads. Large longitudinal forces such as bird strike would normally be mostly reacted in these two fittings, which, without mitigation would result in overloading the airframe. As seen in FIG. 5, a nose portion 33 of the adapter plate 30 that is forward of the lugs 20*a* and 20*b* therefore provides reactive structure adapted to be stiffer in the vertical direction. This facilitates transforming a longitudinal load, such as an impact force on the radome 38 (and/or skirt 36), represented by arrow 116, into an induced downward vertical deflection. Thus the intermediate clevis pairs 22*a*, 22*b*, 24*a*, 24*b* and the aft clevis 26 and aft lug 28 will provide reaction for the induced vertical deflection of the adapter plate 30, reducing the loading on the forward support structure. For the implementation shown in FIG. 5, a forward arcuate portion 50 of the skirt flange 35 and a forward arcuate rib 52 joined to the forward arcuate portion 50 with a plurality of longitudinal ribs 54 and transverse ribs 56*a*, 56*b*, distribute the impact force as represented by arrows 118, 120. Central reaction ribs 58*a*, 58*b* extending aft from the forward arcuate rib 52 further transfer the load induced by the impact force to angle ribs 60*a*, 60*b*, as represented by arrows 122, the angle ribs extending from the central reaction ribs 58*a*, 58*b* laterally and aft terminating proximate side pin receiving pockets 61*a*, 61*b* positioned over the first intermediate devises 22*a*, 22*b*. To further facilitate load shifting, stiffness of the adapter plate 30 around the forward lugs 20*a*, 20*b* is reduced through the removal of shear webs to provide apertures 66*a* around the geometry of lug receiving pockets 62*a*, 62*b*, which surround the forward lugs 20*a*, 20*b*. Shear webs 66*b* are provided in the thickness of surrounding transverse ribs 64*a*, 64*b* is sized to reduce the longitudinal loading of the forward lugs 20*a*, 20*b* while satisfying flight load requirements. The cross sectional area of the adapter plate 30 is increased by 16 to 25 percent in between transverse ribs 64*a*, 64*b* to lug receiving pockets 61*a*, 61*b* to further control the vertical stiffness. These features on the adapter plate reduce the longitudinal stiffness forward of lugs 20*a* and 20*b* and increase the longitudinal and vertical stiffness aft of the lugs 20*a*, 20*b* to accommodate the desired translation of lateral impact forces into vertical forces to be reacted by the first and second intermediate devises 22*a*, 22*b*, 24*a*, 24*b*, as well as the aft clevis 26 and lug 28. This avoids any necessity for reacting longitudinal loading in the first and second intermediate devises 22*a*, 22*b*, 24*a*, 24*b*, the aft clevis 26 or lug 28.

Figure 6:
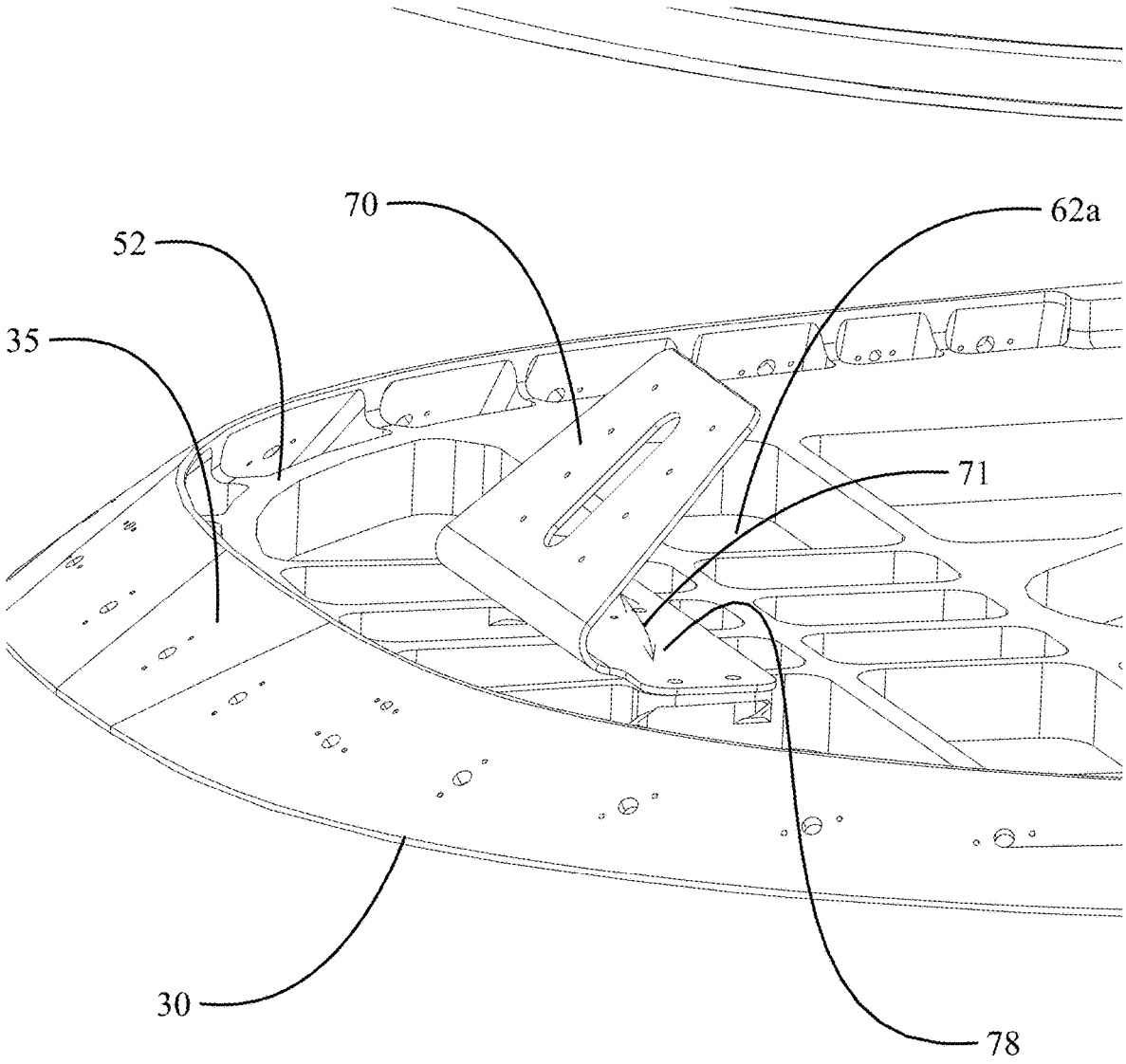
FIG. 6 is a partial pictorial view of the implementation of the adapter plate including a bird strike deflector.
Figure 7A:
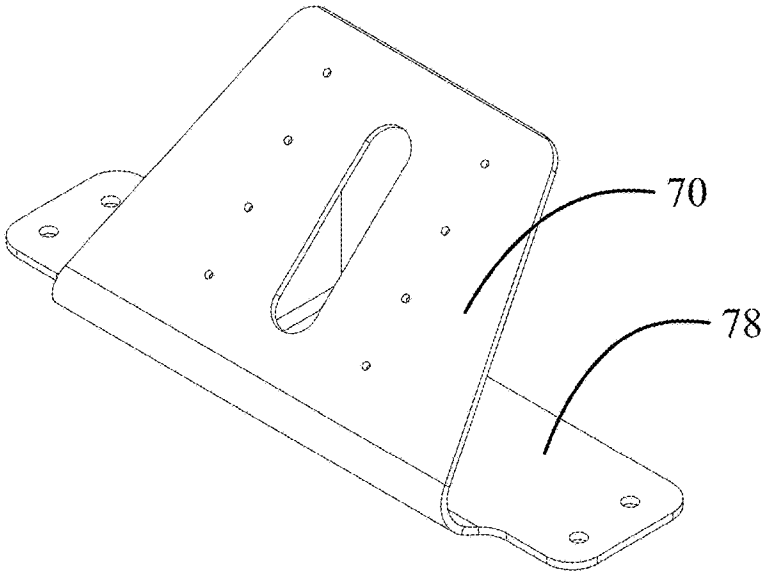
FIGS. 7A and 7B are detailed front and rear pictorial depictions of the bird strike deflector.
Figure 7B:
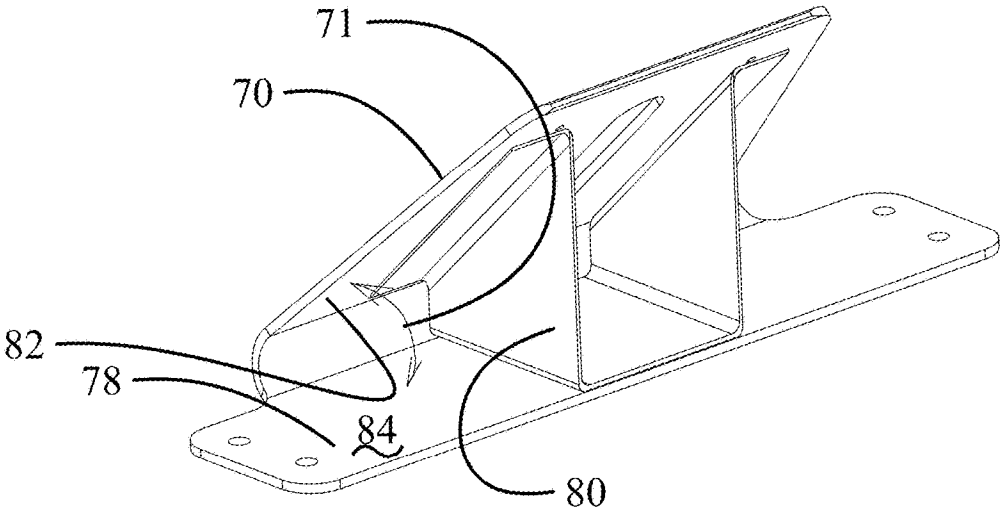

Additional protection specifically for bird strike loads is provided by a deflector 70 as best seen in FIG. 6 and FIGS. 7A and 7B. For the implementation shown, the deflector 70 is mounted to a central pad 72 located intermediate and connected to the central reaction ribs 58*a* and 58*b* and lateral pads 74*a*, 74*b* which extend from intermediate longitudinal ribs 76*a*, 76*b* (best seen in FIG. 5). The deflector 70 is attached to angularly extend with a deflection angle 71 from a mounting base 78 for connection to the central pad 72 and lateral pads 74*a*, 74*b*. The deflection angle 71 is determined by available height between the adapter plate 30 and radome 38; the location of the antenna assembly 39 relative to the deflector 70 mounting position and shape of the antenna assembly 39 and associated gap between the deflector and antenna assembly; and the profile of the radome 38 in the proximity of the deflector 70; to accommodate varying "hit" locations on the radome 38. A support channel 80 engages a rear surface 82 of the deflector 70 to a top surface 84 of the mounting base 78, in the exemplary implementation shown in the drawings, for added structural support to maintain the deflection angle during an impact. It is desirable to position the deflector 70 as close as possible to the radome 38 to support the radome while deflecting the bird. The deflector 70 requires sufficient stiffness to avoid any significant contact with the antenna assembly 39 and the deflector must have sufficient compliance and parallelism to avoid significant damage to the antenna assembly should contact occur. The less distance available between the adapter plate 30 requires additional stiffness in the deflector 70 and filleting or chamfering of the deflector may be desirable if stiffness requirements are over constraining.

Figure 8:
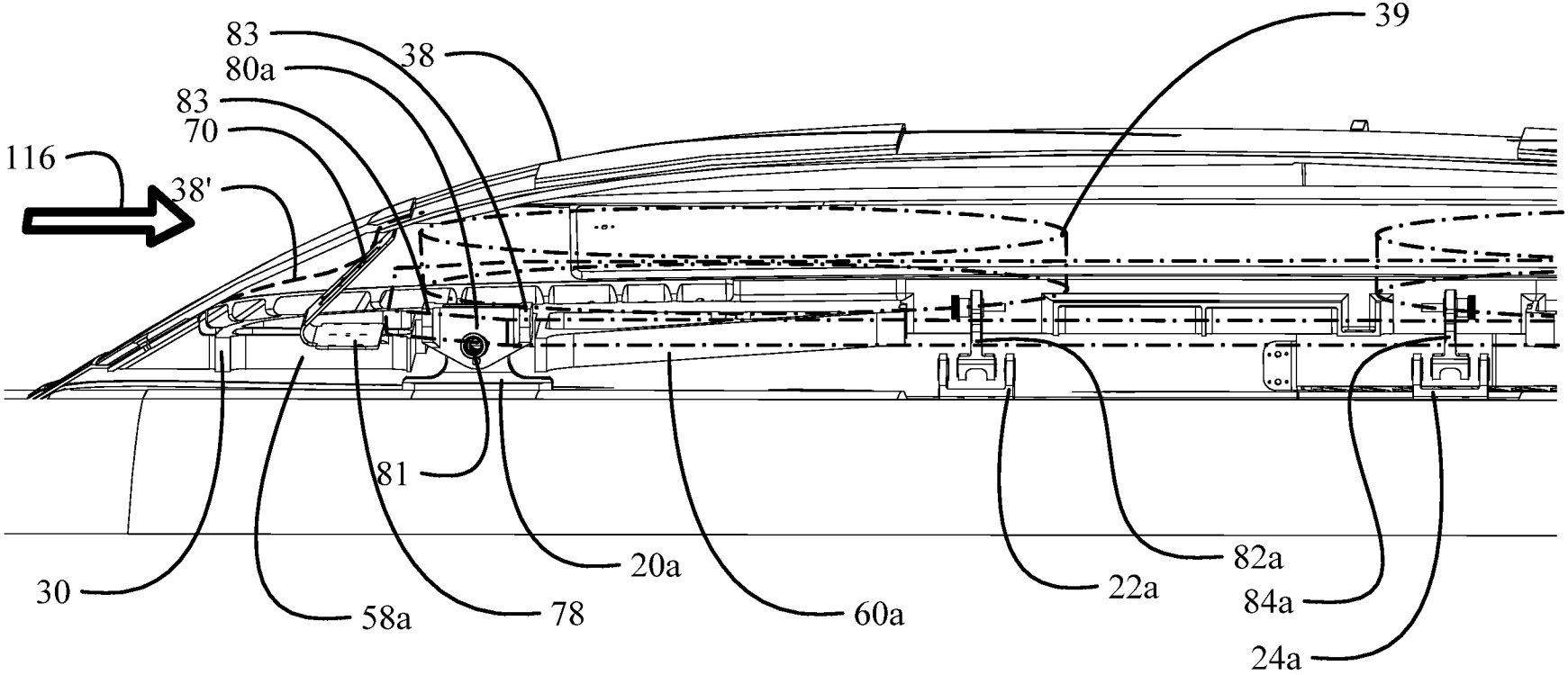
FIG. 8 is a partial side sectional view of the implementation of the adapter plate and bird strike deflector plate (slightly rotated for clarity in depiction of the structural elements); and, FIG. 9 is a flow chart showing a method for redirecting bird strike impact forces using an adapter plate.
Figure 9:
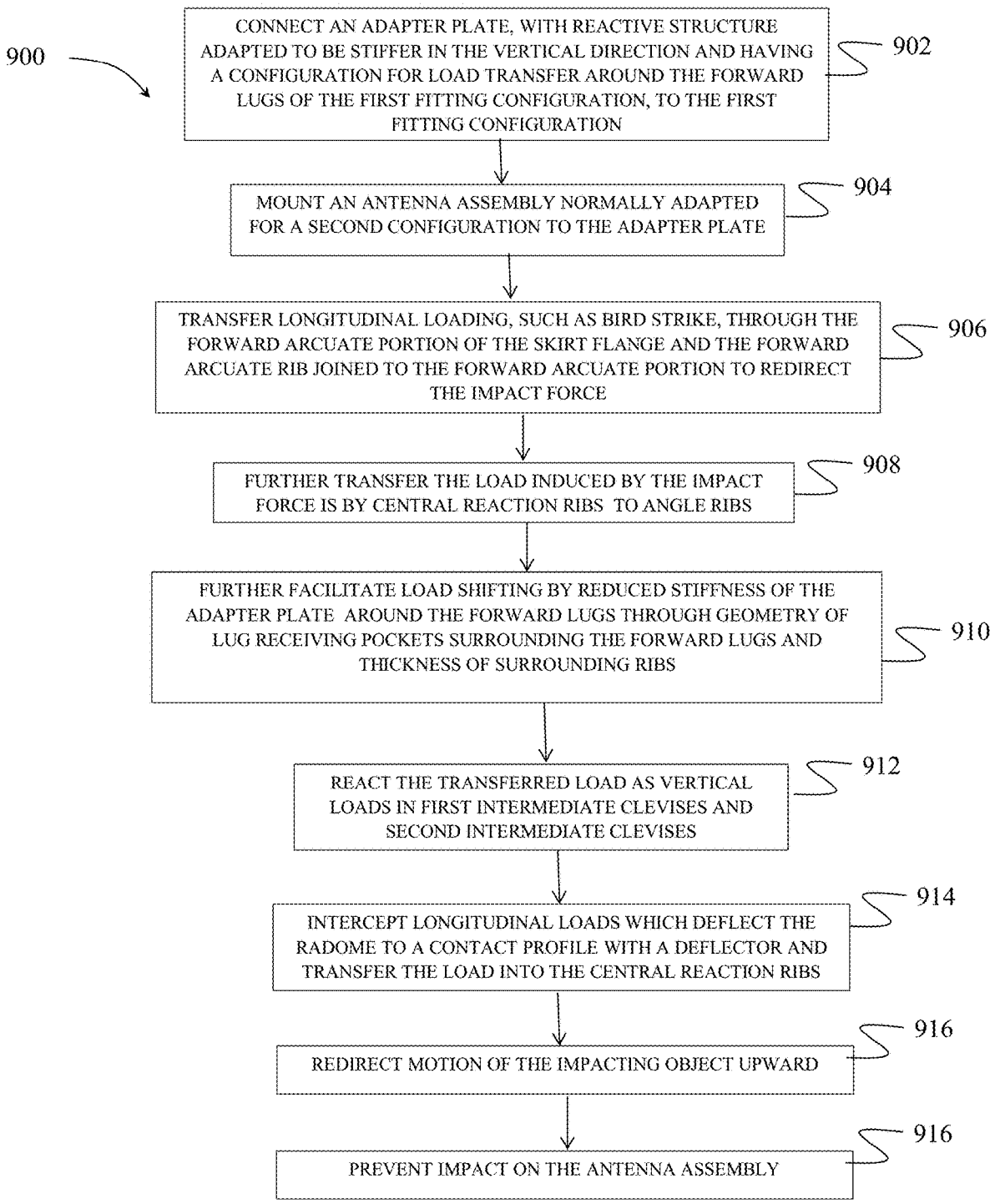

As seen in FIG. 8, the deflector 70 is inset from the radome 38 providing a gap to allow initial flexing of the radome upon impact by a bird or other mass inducing load represented by arrow 116. Upon deflection of the radome 38 to a contact profile 38' engaging the deflector 70, load is transferred through the deflector to the adapter plate 30. The deflector 70, attached through mounting base 78 to central pad 72 and central reaction ribs 58*a*, 58*b* as previously described, allows transfer of the longitudinal forces around the forward lugs 20*a*, 20*b* for reaction as vertical loads in intermediate devises 22*a*, 22*b*, 24*a*, 24*b*, aft clevis 26 and aft lug 28 as described with respect to FIG. 5. Positioning of the deflector 70 forward of the antenna assembly 39 prevents impact to the antenna assembly and the angular orientation of the deflector 70 with deflection angle 71 urges any impacting load, such as a bird, upward to avoid or reduce damage to the radome 38 and antenna assembly 39.

Employing the connector element set 32 (seen in FIG. 2A), attachment of the adapter plate 30 to the forward lugs 20*a*, 20*b* is accomplished with laterally oriented forward engagement clevises 80*a*, 80*b* having rotational bearings 81 (seen in FIG. 8) to allow rotational freedom about lateral axes 21 (seen in FIG. 3). The forward engagement clevises incorporate fore and aft attachment flanges 83 to engage the surrounding ribs 64*a*, 64*b* of the lug receiving pockets 62*a* and 62*b*. Adapter plate 30 is secured to the first intermediate clevises 22*a*, 22*b* and second intermediate clevises 24*a*, 24*b* (spaced aft of the first intermediate clevises as seen in FIG. 2A) with pin rods 82*a*, 82*b* and 84*a*, 84*b*, respectively, (attachment axles not shown for clarity) allowing vertical load reaction. In the exemplary implementation, pin attachment to the adapter plate 30 is an eccentric design with a spline around the periphery to index the rotational axis. This design feature substantially eliminates any preload of the linking structure of the pin rods 82*a*, 82*b*, 84*a*, 84*b*. Attachment of the pin rods to the clevises 22*a*, 22*b*, 24*a*, 24*b* is typically a straight shoulder bolt. Pin rod attachment allows lower profile adapter plate thereby reducing drag and provides greater ease of installation and removal. The first and second intermediate clevises are oriented longitudinally along axes 23 for enhanced conversion of the vertical component induced by the adapter plate 30 in the shifted load from the forward lugs 20*a*, 20*b*. Aft clevis 26 is connected to the adapter plate 30 with pin rod 86 and aft lug 28 is connected to the adapter plate 30 with aft engagement clevis 88.

The described implementation provides a method 900 as shown in FIG. for attachment of an antenna assembly 39 normally adapted for the second fitting configuration 40 to the first fitting configuration 18. An adapter plate 30, with reactive structure adapted to be stiffer in the vertical direction and having a configuration for load transfer around the forward lugs 20*a*, 20*b* of the first fitting configuration, is connected to the first fitting configuration 18, step 902. The antenna assembly is mounted to the adapter plate 30, step 904. Longitudinal loading, such as bird strike, is transferred through the forward arcuate portion 50 of the skirt flange 35 and the forward arcuate rib 52 joined to the forward arcuate portion 50 to redirect the impact force, step 906. The load induced by the impact force is further transferred by central reaction ribs 58*a*, 58*b* to angle ribs 60*a*, 60*b*, step 908. Reduced stiffness of the adapter plate 30 around the forward lugs 20*a*, 20*b* through geometry of lug receiving pockets 62*a*, 62*b*, which surround the forward lugs 20*a*, 20*b*, and thickness of surrounding ribs 64*a*, 64*b* further facilitates load shifting, step 910. The transferred load is reacted as vertical loads in first intermediate devises 22*a*, 22*b* and second intermediate devises 24*a*, 24*b*, step 912. A deflector 70 intercepts longitudinal loads which deflect the radome 38 to a contact profile 38' and transfers the load into the central reaction ribs 58*a*, 58*b*, step 914, redirects motion of the impacting object upward, step 916, and prevents impact on the antenna assembly 39, step 918.

Having now described various implementations of the disclosure in detail as required by the patent statutes, those skilled in the art will recognize modifications and substitutions to the specific implementations disclosed herein. Such modifications are within the scope and intent of the present disclosure as defined in the following claims.

What is claimed is:

1. An antenna and radome assembly comprising:

an adapter plate engaging a first fitting configuration mounted to an aircraft fuselage, said adapter plate mechanically supporting an antenna assembly wherein said antenna assembly is originally configured for a second fitting configuration, the first fitting configuration comprising two forward lugs reacting longitudinal force on the adapter plate and a pair of first intermediate clevises and a pair of second intermediate clevises, spaced aft of the first intermediate clevises, said first intermediate clevises and second intermediate clevises connected to the adapter plate with pin rods aft of the forward lugs with regard to a flight direction, said first intermediate clevises and second intermediate clevises reacting vertical loads arising from the induced downward vertical deflection;

a radome attached to the adapter plate and enclosing the antenna assembly;

said adapter plate having at least a nose portion comprising a forward arcuate portion of a skirt flange and a forward arcuate rib joined to the forward arcuate portion with a plurality of longitudinal ribs providing reactive structure adapted to transform a longitudinal load on the radome into an induced downward vertical deflection; and central reaction ribs extending aft from the forward arcuate rib to angle ribs, the angle ribs extending from the central reaction ribs laterally and aft.

2. The antenna and radome assembly as defined in claim 1 further comprising an aft clevis.

3. The antenna and radome assembly as defined in claim 1 wherein the two forward lugs are engaged to the adapter plate with forward engagement clevises.

4. The antenna and radome assembly as defined in claim 3 wherein the forward engagement clevises each provide rotation about a lateral axis.

5. The antenna and radome assembly as defined in claim 1 wherein the angle ribs terminate proximate side pin receiving pockets positioned over the first intermediate clevises.

6. The antenna and radome assembly as defined in claim 1 further comprising a deflector angularly mounted to the adapter plate, said deflector is inset from the radome.

7. The antenna and radome assembly as defined in claim 1 wherein a deflector angularly extending from a mounting base is connected to the at least a nose portion.

8. The antenna and radome assembly as defined in claim 7 wherein the mounting base is attached to a central pad intermediate and connecting to the central reaction ribs.

9. A method for attachment and operation of an antenna assembly comprising:

connecting an adapter plate with reactive structure adapted to be stiffer in a vertical direction and having a configuration for load transfer around forward lugs of a first fitting configuration to the first fitting configuration which comprises two forward lugs reacting longitudinal force on the adapter plate and a pair of first intermediate clevises and a pair of second intermediate clevises, spaced aft of the first intermediate clevises, said first intermediate clevises and second intermediate clevises connected to the adapter plate with pin rods aft of the forward lugs with regard to a flight direction, said first intermediate clevises and second intermediate clevises reacting vertical loads arising from the induced downward vertical deflection;

mounting an antenna assembly to be supported by the adapter plate wherein said antenna assembly is originally configured for a second fitting configuration;

attaching a radome to the adapter plate and enclosing the antenna assembly; transferring a longitudinal load through a nose portion of the adapter plate, said nose portion comprising a forward arcuate portion of a skirt flange and a forward arcuate rib joined to the forward arcuate portion with a plurality of longitudinal ribs providing reactive structure adapted to transform a longitudinal load on the radome into an induced downward vertical deflection and central reaction ribs extending aft from the forward arcuate rib to angle ribs, the angle ribs extending from the central reaction ribs laterally and aft and, reacting the transferred load as vertical loads in first intermediate clevises.

10. The method as defined in claim 9 further comprising:

intercepting the longitudinal load upon deflection of the radome to a contact profile with a deflector;

transferring the longitudinal load into the central reaction ribs in the forward arcuate portion of the adapter plate.

11. The method as defined in claim 10 further comprising:

redirecting motion of an impacting object asserting the longitudinal load downward with the deflector; and preventing impact on the antenna assembly with the deflector.

12. The method as defined in claim 9 further comprising reacting the transferred load as a vertical load in the second intermediate clevises.

13. The method as defined in claim 9 wherein the step of transferring a longitudinal load comprises transferring the longitudinal load through the forward arcuate rib.

14. The method as defined in claim 13 wherein the step of transferring a longitudinal load comprises transferring the longitudinal load through the central reaction ribs extending aft from the forward arcuate rib to the angle ribs, the angle ribs extending from the central reaction ribs laterally and aft.

15. An antenna and radome assembly comprising:

an adapter plate engaging a fitting configuration mounted to an aircraft fuselage, said adapter plate mechanically supporting an antenna assembly, the fitting configuration comprising two forward lugs reacting longitudinal force on the adapter plate and a pair of first intermediate clevises and a pair of second intermediate clevises, spaced aft of the first intermediate clevises, said first intermediate clevises and second intermediate clevises connected to the adapter plate with pin rods aft of the forward lugs with regard to a flight direction, said first intermediate clevises and second intermediate clevises reacting vertical loads arising from the induced downward vertical deflection;

a radome attached to the adapter plate and enclosing the antenna assembly, wherein said adapter plate has a nose portion comprising:

a forward arcuate portion of a skirt flange and a forward arcuate rib joined to the forward arcuate portion with a plurality of longitudinal ribs providing reactive structure adapted to transform a longitudinal load on the radome into an induced downward vertical deflection; and central reaction ribs extending aft from the forward arcuate rib to angle ribs, the angle ribs extending from the central reaction ribs laterally and aft; and, a deflector angularly mounted to the adapter plate, said deflector adjacent to but inset from the radome.

16. The antenna and radome assembly as defined in claim 15 wherein the deflector angularly extends from a mounting base connected to the nose portion.

17. The antenna and radome assembly as defined in claim 16 wherein the mounting base is attached to a central pad intermediate and connecting to the central reaction ribs.

18. The antenna and radome assembly as defined in claim 17 wherein the angle ribs terminate proximate side pin receiving pockets positioned over the first intermediate clevises.

* * * * *